US006093118A

United States Patent [19]

Simpson

[11] Patent Number: 6,093,118

[45] **Date of Patent: *Jul. 25, 2000**

[54] SPINNING BASEBALL DEVICE

[76] Inventor: Alan H. Simpson, 20 Merion Ct., Dover, Del. 19904-2319

[ * ] Notice: Under 35 U.S.C. 154(b), the term of this patent shall be extended for 361 days.

[21] Appl. No.: 08/620,256

[22] Filed: Mar. 22, 1996

[51] Int. Cl.[7] ..... A63B 69/00

[52] U.S. Cl. ..... 473/424; 473/451; 434/247

[58] Field of Search ..... 273/26 R, 26 E, 273/29 A; 434/247; 473/422–424, 451

[56] References Cited

U.S. PATENT DOCUMENTS

| | | | |
|---|---|---|---|
| 3,152,803 | 10/1964 | Sain | 273/26 R |
| 4,186,921 | 2/1980 | Fox | 273/26 E |
| 4,286,783 | 9/1981 | Newcomb | 273/26 R |
| 5,230,506 | 7/1993 | Cipriano | 273/26 R |
| 5,340,101 | 8/1994 | Lawson | 273/26 E |
| 5,374,056 | 12/1994 | Scher | 273/26 E |

FOREIGN PATENT DOCUMENTS

| | | | |
|---|---|---|---|
| 2113601 | 9/1972 | Germany | 273/58 C |

*Primary Examiner*—Jeanette Chapman
*Assistant Examiner*—Mitra Aryanpour

[57] ABSTRACT

When spun by an electric drill, this device allows a batter to practice reading the spin on a pitched baseball. The device creates this spin, without a baseball being pitched. The device is inexpensive, single person operated, small area safe, and serves more than one batter at the same time.

20 Claims, 3 Drawing Sheets

SPINNING BASEBALL DEVICE

CROSS REFERENCES TO RELATED APPLICATIONS

This application is related to application Ser. No. 08/024,415, filed Mar. 1, 1993.

BACKGROUND

1. Field of Invention

A pitched baseball spins according to the type of pitch which has been thrown. Different types of pitches include fastball, curveball, and slider. Although how the baseball spins can vary from pitcher to pitcher, there is a manner in which the baseball spins that can be considered typical for each type of pitch. Being able to recognize what is typical for each type of pitch, helps the batter to know what to look for when he is reading the spin of a pitched baseball. When a batter can read the spin of the pitched baseball, he knows what type of pitch is coming and he can better adjust his swing for the type of pitch.

The operation of this invention creates a spin on a ball. That ball that is spun looks like a baseball. The spin that is created is the same spin as the spin for a particular type of pitch.

2. Description of Prior Art

The conventional method to practice reading the spin of a pitched baseball requires a pitcher to pitch a ball to a catcher. Therefore the conventional method has the following disadvantages:

A catcher is needed to usually stop the ball's flight

A backstop is needed to sometimes stop the ball's flight

For safety, an area surrounding the ball's flight must be kept vacant; therefore, the activity must take place in a large area, usually outdoors For safety, the ball's flight prohibits more than one batter standing in a batter's box at the same time Catch (or retrieve) and throw back of the thrown ball takes time There must be enough skilled pitchers able to throw enough pitches for all the practicing batters

SUMMARY

The objective of this invention is to create the spin of a pitched baseball, and to create the spin without having to pitch the ball. Providing the spin will allow the batters to practice reading the spin of a pitched ball. However, because the spin is provided without being pitched, all the disadvantages I have listed for the conventional method to practice, would be eliminated.

This invention contemplates utilizing the spinning motion created by an electric drill, to spin a ball. The ball that is spun looks like a baseball. The spin on the ball is the same spin as the spin is for a particular type of pitch (fastball, curveball, or slider).

The invention is embodied by:

a ball which looks like a baseball a spindle to transmit rotational movement from an electric drill to the ball bores within the ball to provide the spindle access within the ball and to provide means to prevent slippage between the spindle and the ball specific locations where a bore appears on the ball's surface to create spins with specific and intended axes of rotation.

WHY THE INVENTION WORKS

These are the reasons why this invention can provide a spin on a baseball appearing ball which is the same spin that a batter sees while looking at a pitched baseball.

1. The revolutions per minute of the spin on a pitched baseball is in the same range as the r.p.m.'s induced by common electric motors such as the motor and gear systems found in hand held electric drills. A 1959 paper by Lyman J. Briggs, in the *American Journal of Physics*, p. 593, shows pitched ball spins range from 600 to 1600 r.p.m.'s.
2. For the distance in which a batter must read the spin of a pitched ball (the first quarter of its movement from pitcher to batter), the batter's perspective of the pitched ball spin remains almost the same. That is, both the side to side and up and down angles between the batter's line of sight and the direction of the ball changes insignificantly for the ball's first quarter of flight. This happens regardless of what type of batter (left handed or right handed) faces what type of pitcher (left handed or right handed, side arm or over hand). Attachment I contains calculation results showing the changes in the left to right and up and down angles of a pitched ball through the distance the batter must read the pitched ball spin. Thus, even though a spinning baseball created by this invention has no forward movement, the spin appears the same as a spin on a baseball that was pitched.

REFERENCE NUMERALS IN THE DRAWINGS

10. Ball

11. Seam

12. Covering Material

13. Spindle

14. Flat Keyway on Spindle

15. Bore

16. Key of Bore

17. A Location Where a Bore Appears on the Ball's Surface

18. Where Seams Turn or Change Direction

19. Midpoint of Most Narrow Width of Covering Material

20. One Pair Where Seams Turn or Change Direction

21. Spindle of a Second Device

22. A Location Where a Bore Appears on a Second Ball's Surface

23. The Unoccupied End of a Bore in the First Device that is in Line with the Spindle of the First Device

DESCRIPTION OF PREFERRED EMBODIMENT

A spinning baseball device is made by placing a spindle into a bore which is inside a ball. The type of ball and the type of spindle envisioned by this invention is described below under the headings BALL and SPINDLE. The bores which are inside the ball, are further described under the heading BORES. There are also specific locations where a bore appears on the ball's surface. Details of such locations are described under the heading LOCATIONS WHERE A BORE APPEARS ON THE BALL'S SURFACE.

Figure 2:
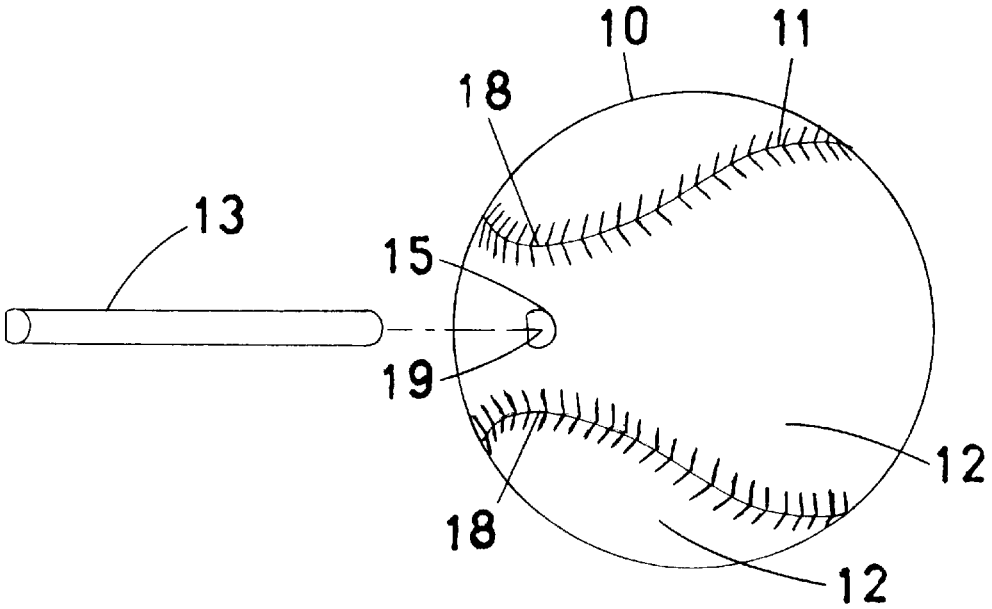
FIG. 2—A Bore Location of Thrown Against the Seams

BALL (Refer to FIG. 2)

The following is a description of the ball that is part of this invention. The ball 10 is round and has the surface appearance of "a baseball". The surface of a baseball consists of two bi-spatular pieces of covering material 12 which are usually white. These two pieces of covering material 12 are sewn together with thread which is usually red. The continuous path where the two pieces of covering material are sewn together, is known as the seam 11. However, lengths of continuous seam which go in different directions are often considered different seams. Therefore a baseball is often thought of having seams, rather than just one seam. The covering material has words printed on it which are usually black or blue. Therefore, for a ball 10 to have surface appearance of a baseball, the ball's surface must be within the above description.

For a ball 10 to have the surface appearance of a baseball does not limit the ball's surface material to the same as those of a baseball. Preferably, the ball's surface is not sewn together and is one piece of material. Preferably the ball's surface material is all plastic. The ball's surface is made more inexpensive with the use of imitation baseball surfaces. It is necessary, however, that whatever gives the appearance of the seam 11 on the ball 10 follows the same path along the surface as the seam follows on a baseball. Throughout the specifications and claims, that part of the ball's surface that gives the appearance of a seam, shall be referred to as a seam 11. This will be so even if the seam 11 is not made by sewing pieces of covering material together.

The ball of this invention is made with less costs than a baseball because of a difference in their inside material. There is no reason to make the inside of the ball of this invention with hitable material. Therefore the inside of the ball is made with lightweight material so it can be made cheaper and so it has less weight which needs to be supported during its use.

Figure 1:
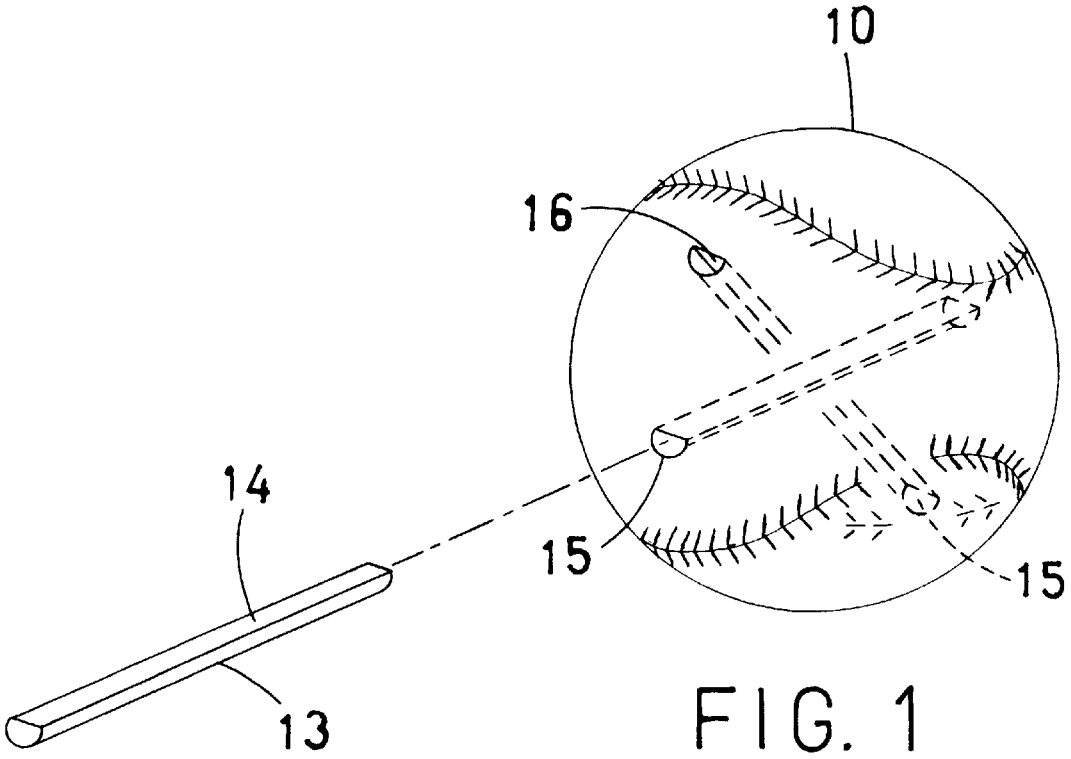
FIG. 1—Spinning Baseball Device

SPINDLE (Refer to FIG. 1)

The following is a description of a spindle or a small shaft which is part of this invention. The spindle 13 is a size and shape allowing it to be put into a drill chuck. The spindle 13 shall be made inconspicuous. The spindle shall be made inconspicuous by making the spindle as small as its support function allows and by making it of transparent material or making it an inconspicuous color. The spindle is straight. The spindle has a flat Keyway 14.

BORES (Refer to FIG. 1)

A spindle 13 penetrates a ball 10 by placing the spindle 13 into a bore 15 or cylindrical cavity which is inside the ball 10. The ball has more than one bore 15. Inside each bore is a key 16 which matches the keyway 14 on the spindle 13.

A bore is straight and goes through the center of the ball. A bore's length is the same as a diameter of a ball. Therefore a bore creates two openings at the ball's surface.

A location where a bore appears on the ball's surface is made inconspicuous. The walls of a bore is made the same color as the ball's covering material, in order to make the location inconspicuous.

Figure 3:
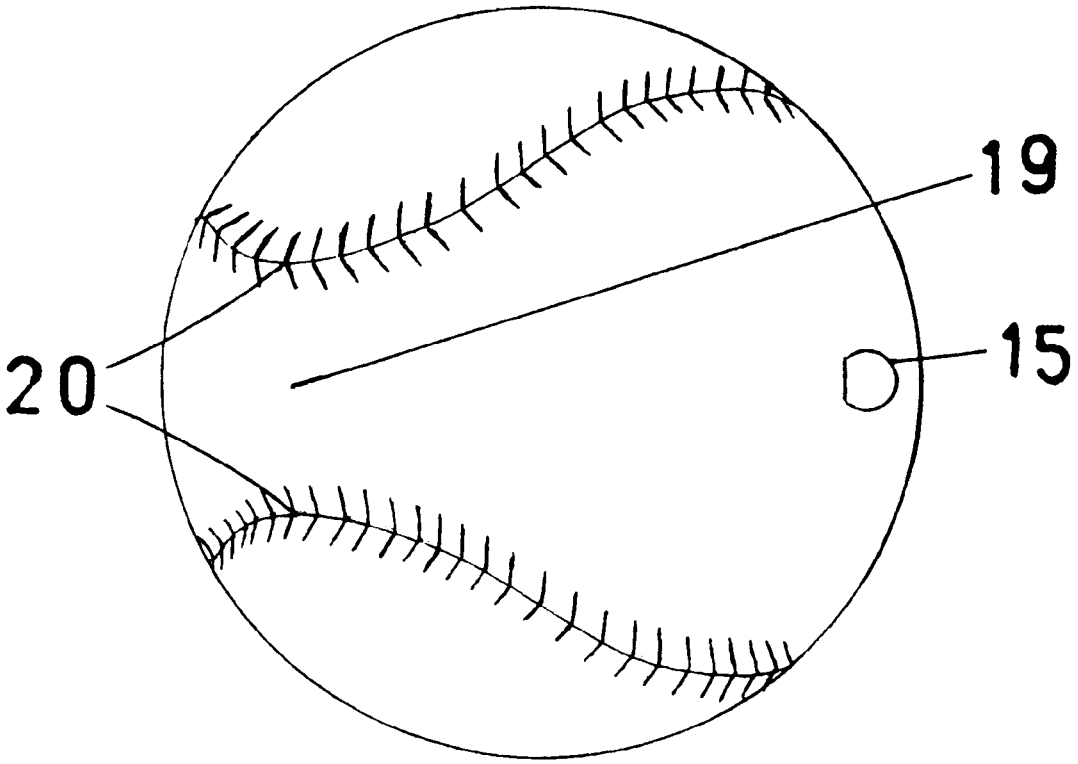
FIG. 3—A Bore Location of Thrown With the Seams

LOCATIONS WHERE A BORE APPEARS ON THE BALL'S SURFACE (Refer to FIG. 2 and FIG. 3)

The spindle 13 enters the ball 10 by placing the spindle 13 inside a bore 15 which penetrates the ball 10. Where a bore appears on the ball's surface is a location that is specific and intended or purposed. A location where a bore appears a ball's surface can be described by where that location is in relation to the ball's seams 11. Also, a location where a bore appears on a ball's surface can be described by where that location is within the ball's covering material 12. The following are examples of two different specific locations where a bore appears on a ball's surface.

FIG. 2 shows a bore location of thrown against the seams. The following sentence is a description sufficient to describe a bore location of thrown against the seams. For a bore location of thrown against the seams, the four places where the seams turn or change direction 18 are at equal distance from the bore 15. The following sentence is another description sufficient to describe the bore location of thrown against the seams. The location where the bore appears on a ball's surface is at a most narrow width of the covering materials and is at the most narrow width's midpoint 19 or center.

FIG. 3 shows a bore location of thrown with the seams. The following two sentences are a description sufficient to describe a bore location of thrown with the seams. For a bore location of thrown with the seams, the midpoints or center of both the two most narrow width of the covering material 19 are at equal distances from the bore 15. These equal distances form the bore are a same distance as a radius of the ball. The following sentence is another description sufficient to describe a bore location of thrown with the seams. For a bore location of thrown with the seams, and if turns in the seam closest to each other are paired 20, for one pair of the places where the seam turns or changes direction, each member turn is a ball radius distance away from the bore 15.

OPERATION OF THE INVENTION

An operator of a spinning baseball device tightens an electric drill's chuck onto the spinning baseball device's spindle 13 (See FIG. 1). The spindle 13 is placed into a bore 15 which penetrates the ball 10. Because all locations where bores appear on a ball's surface are specific and intended or purposed, the device always operates with an intended axis of rotation. For example, if an operator places a spindle into a bore location of thrown against the seams, the device will spin with an intended axis of rotation. That axis of rotation would be the same as if the ball had been gripped against its seams and then pitched. As a second example, if an operator places a spindle into a bore location of thrown with the seams, the device's axis of rotation would be the same as if the ball had been gripped with its seams and then thrown.

Once the operator places the spindle in a bore, he must make other adjustments to simulate the spin of a particular type of pitch fastball, curveball, etc. The operator must tilt the device's axis of rotation, which will be along the length of the spindle, so that it will be proper for a particular type of pitch.

He must then face so that the direction of the spin to the batter will be proper for a particular type of pitch.

Holding the device in that position, the operator turns the drill on. If the operator is using a variable speed drill, he operates the drill at a speed according to the type of pitch he is simulating. For example, curveballs spin more slowly than fastballs. One or more batters stand a distance away and practice seeing the spin created by the device operating. The operator then displays different spins.

A different axis of rotation is displayed by removing the spindle from the ball and placing the spindle into a different bore.

Figure 4:
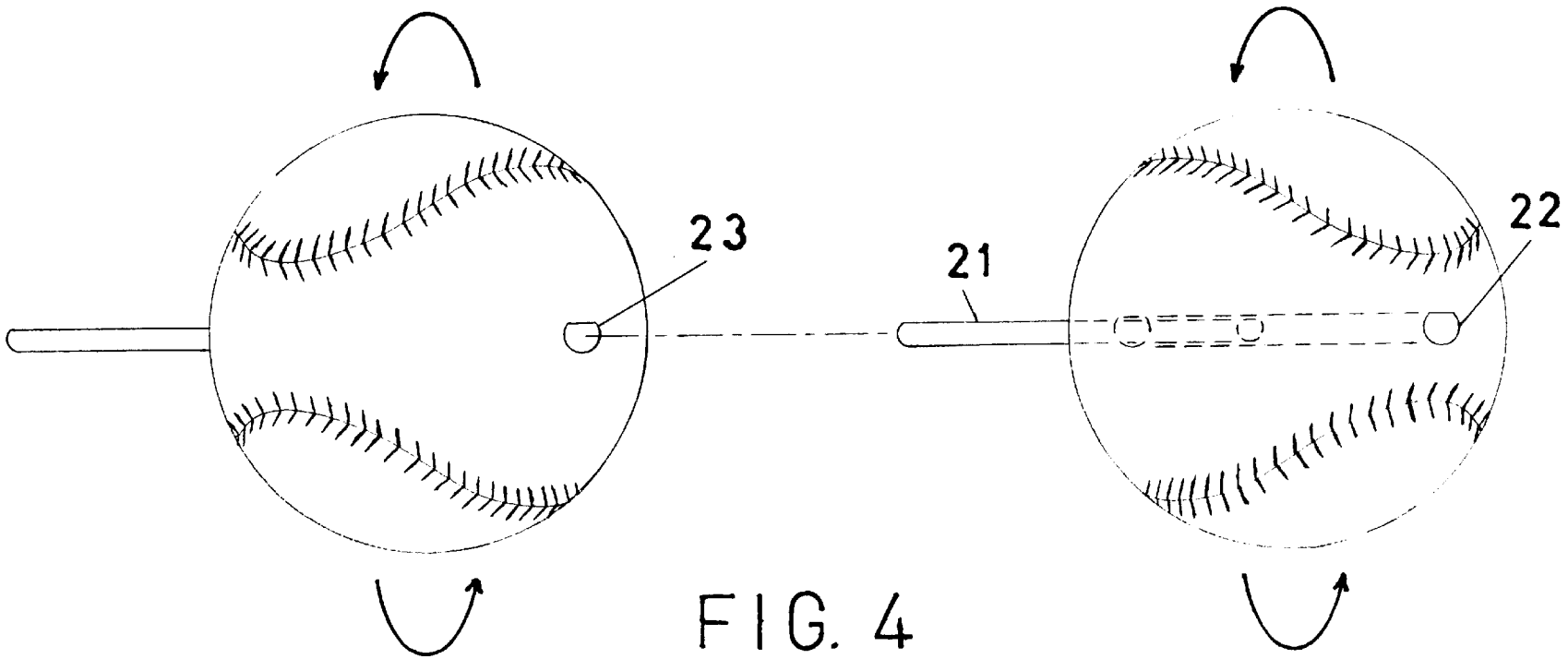
FIG. 4—Connection of Two Spinning Baseball Devices

Another way of displaying a different axis of rotation is by using two spinning baseball devices at the same time (See FIG. 4). To operate in this manner, the spindle of a second spinning baseball device 21 is placed into a bore which has a location 22 where the bore appears on its ball's surface, that is different from the bore used in the first device. Then the other end of the spindle of the second device is placed into the bore 23 which is being used in the first device, but the spindle is placed into the unoccupied end of that bore. The first device is kept into the drill. When the drill is turned on, two spinning baseball devices will operate off the same drill. Each device will display, at the same time, a spin with a different axis of rotation at the same time.

CONCLUSIONS AND SCOPE

The preferred embodiment described above will meet the objective. That objective is to create the spin of a pitched baseball, and to create the spin without having to pitch the ball.

The ball which is part of this invention has been described as having the surface appearance of a baseball. It is readily apparent that the invention could utilize a ball having the surface appearance of a softball and work equally well. A generic description which includes only a baseball and a softball is a seamed ball that is typically pitched. That is, baseballs and softballs are the two kinds of seamed balls that are typically pitched.

The balls of spinning baseball devices are not limited to a size which are the same size as a baseball or a softball. In order to utilize the invention at a closer distance to the batter than regulation distance thus saving practice space and to make the batter's viewing task equally challenging, the size of the balls of spinning baseball devices can be made smaller than regulations size baseballs or softballs.

This invention envisions more specific locations where a bore appears on the ball's surface than the two examples described above. Pitchers can grip a baseball more ways than with the seams or against the seams. However, each location where a bore appears on the ball's surface is specific and purposed or intended.

It is readily apparent that by reducing their lengths, each straight bore in a ball can be made so that each bore has only one opening on the ball's surface. A spinning baseball device so created can still be operated. However, with no second opening, a second spinning baseball device cannot be connected up to the first spinning baseball device.

It is readily apparent that slippage between the spindle and the bore can be further ensured by permanently uniting the spindle with the bore by glue or tightness of fit.

It is readily apparent that a spinning baseball device can be made with only one bore. A spinning baseball device so made, will operate, but can only be spun around one axis of rotation.

ATTACHMENT I

VIEWING DISTORTIONS

There are two possible viewing distortions caused by the difference between a batter's line of sight, and the direction of an incoming ball:

SIDE TO SIDE ANGLE:

| | AT START OF TRAVEL | AT 12 FEET OF TRAVEL |
|---|---|---|
| Right handed batter facing a right handed side arm pitcher. | 1.87537° away from straight on to 3rd base side of ball. | 2.0748856° away from straight on to the 3rd base side of ball. |
| Right handed batter facing a left handed side arm pitcher. | 1.833146° away from straight on to the 3rd base side of ball. | 2.331362° away from straight on to the 3rd base side of ball. |
| Right handed batter facing an overhanded delivery from center of mound. | 1.8431456° away from straight on to the 3rd base side of ball. | 2.34532° away from straight on to the 3rd base side of ball. |

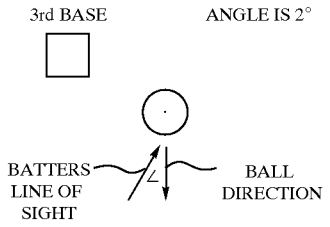

REVOLUTIONS PER MINUTE DISTORTION:

When a batter looks down increasingly more on a baseball as it approaches home plate, the batter sees the ball spin at a rate slightly different than the rate at which the ball is actually spinning. For a ball approaching the plate with top spin (curve ball), the revolutions per minute seen is less than the ball's actual r.p.m.'s. For a ball approaching the plate with backspin (fastball), the revolutions per minute seen is less than the ball's actual r.p.m.'s.

My calculations slow the baseball's revolution per minute is distorted by less than 0.1% by the batter having to look more and more down on the ball during its first 12 feet. Thus, the difference between actual and seen can be ignored.

I claim:

1. A device attachable to and used with a hand-held electric drill, to enable someone to practice recognizing types of spins common on pitched balls, but without having to pitch a ball, said device comprising:

a. a ball having the surface appearance of a ball selected from the group consisting of baseballs and softballs, and said ball being made of lightweight material, and b. a plurality of bores within said ball, all said bores appearing at said ball's surface at different but specific and intended locations, each said bore appearing at said ball's surface only once, and c. a spindle of sufficient length and small enough diameter so that after placing said spindle into said bore, there remains sufficient length of said spindle outside the ball and said spindle's diameter is sufficiently small so that the said spindle can be placed inside of and held tight by a chuck of an electric drill, and d. means to prevent slippage between said spindle and said bore during operation of the device.

2. The device of claim 1 wherein said ball has the surface appearance of a baseball.

3. The device of claim 2 wherein the size of said ball is smaller than a baseball whereby a batter can beneficially observe the device from a close distance.

4. The device of claim 1 wherein said ball has the surface appearance of a softball.

5. The device of claim 4 wherein the size of said ball is smaller than a softball whereby a batter can beneficially observe the device from a close distance.

6. The device of claim 1, further including an extension of each said bore so that each said bore appears at said ball's surface at two locations.

7. The device of claim 6 wherein said ball has the surface appearance of a baseball.

8. The device of claim 7 wherein the size of said ball is smaller than a baseball whereby a batter can beneficially observe the device from a close distance.

9. The device of claim 6 wherein said ball has the surface appearance of a softball.

10. The device of claim 9 wherein the size of said ball is smaller than a softball whereby a batter can beneficially observe the device from a close distance.

11. A device attachable to and used with a hand-held electric drill, to enable someone to practice recognizing types of spins common on pitched balls, but without having to pitch a ball, said device comprising:

a. a ball having the surface appearance of a ball selected from the group consisting of baseballs and softballs, and said ball being made of lightweight material, and b. a bore within said ball, and bore appearing at said ball's surface at one specific and intended location, and c. a spindle of sufficient length and small enough diameter so that after placing said spindle into said bore, there remains sufficient length of said spindle outside the ball and said spindle's diameter is sufficiently small so that the said spindle can be placed inside of and held tight by a chuck of an electric drill, and d. means to prevent slippage between said spindle and said bore during operation of the device.

12. The device of claim 11 wherein said ball has the surface appearance of a baseball.

13. The device of claim 12 wherein the size of said ball is smaller than a baseball whereby a batter can beneficially observe the device from a close distance.

14. The device of claim 11 wherein said ball has the surface appearance of a softball.

15. The device of claim 14 wherein the size of said ball is smaller than a softball whereby a batter can beneficially observe the device from a close distance.

16. The device of claim 11 wherein said means to prevent slippage is to permanently unite said spindle and said bore and further including an extension of said bore so that said bore appears at said ball's surface at two locations.

17. The device of claim 16 wherein said ball has the surface appearance of a softball.

18. The device of claim 17 wherein the size of said ball is smaller than a baseball whereby a batter can beneficially observe the device from a close distance.

19. The device of claim 16 wherein said ball has the surface appearance of a softball.

20. The device of claim 19 wherein the size of said ball is smaller than a softball whereby a batter can beneficially observe the device from a close distance.

* * * * *